US005654684A

United States Patent [19]

Boyden

[11] Patent Number: 5,654,684

[45] Date of Patent: Aug. 5, 1997

[54] ALARM SYSTEM FOR DETECTING EXCESS TEMPERATURE IN ELECTRICAL WIRING

[75] Inventor: David Boyden, 1114 N. Kedvale, Chicago, Ill. 60651

[73] Assignee: David Boyden, Chicago, Ill.

[21] Appl. No.: 250,095

[22] Filed: May 26, 1994

Related U.S. Application Data

[63] Continuation-in-part of Ser. No. 907,185, Jul. 1, 1992, abandoned .

[51] Int. Cl.[6] ..... G08B 25/10

[52] U.S. Cl. ..... 340/287; 340/288; 340/289; 340/584; 340/693; 169/23; 169/61; 374/141

[58] Field of Search ..... 340/287, 288, 340/289, 286.01, 292, 584, 635, 693; 379/42; 740/501, 506, 286.05; 169/60, 61, 23, 52, 24; 374/141, 183

[56] References Cited

U.S. PATENT DOCUMENTS

| | | | |
|---|---|---|---|
| 3,993,138 | 11/1976 | Stevens et al. | 169/61 |
| 4,082,148 | 4/1978 | Willms | 169/61 |
| 4,227,577 | 10/1980 | Iida | 340/573 |
| 4,310,837 | 1/1982 | Kornrumpf et al. | 340/635 |
| 4,381,503 | 4/1983 | Kobayashi | 340/584 |
| 4,465,904 | 8/1984 | Gottsegen et al. | 379/42 |
| 4,470,711 | 9/1984 | Brozouski | 374/179 |
| 4,493,948 | 1/1985 | Sues et al. | 379/42 |
| 4,521,645 | 6/1985 | Carroll | 379/42 |
| 4,641,127 | 2/1987 | Hogan et al. | 379/42 |
| 4,644,331 | 2/1987 | Matsushita et al. | 340/584 |
| 4,671,362 | 6/1987 | Odashima | 340/578 |
| 4,712,095 | 12/1987 | Georgis, II | 340/584 |
| 4,818,970 | 4/1989 | Natale et al. | 340/539 |
| 4,901,060 | 2/1990 | Lice | 340/635 |
| 4,918,717 | 4/1990 | Bissonnette et al. | 379/42 |

*Primary Examiner*—Jeffery Hofsass
*Assistant Examiner*—Daniel J. Wu
*Attorney, Agent, or Firm*—McAndrews, Held & Malloy, Ltd.

[57] ABSTRACT

The system includes a sensor for each junction box in the building to be guarded, i.e., the residence, and a display panel showing the temperature of any junction box that is heated above the danger point. Another display panel shows the name of the resident and address of the residence, and the location of the heated junction box by room number and junction box number and the shape of the junction box. A plurality of residences are connected with a central station, such as a fire station, by single telephone line to each residence. A single processing unit is located in each residence, and a single such unit in the central display station. A display panel is located in the central station identical with each display in a residence. The central station is provided with a single processing unit responsive to actuating of any and each of the processing units in the residences, the central station having a modem operable for receiving signals from the processing units in the units and processing them according to the respective processing units in the residences. The system also includes rotating extinguisher heads which rotate towards the source of any dangerous heat an extinguish the fire.

5 Claims, 9 Drawing Sheets

Fig. 1
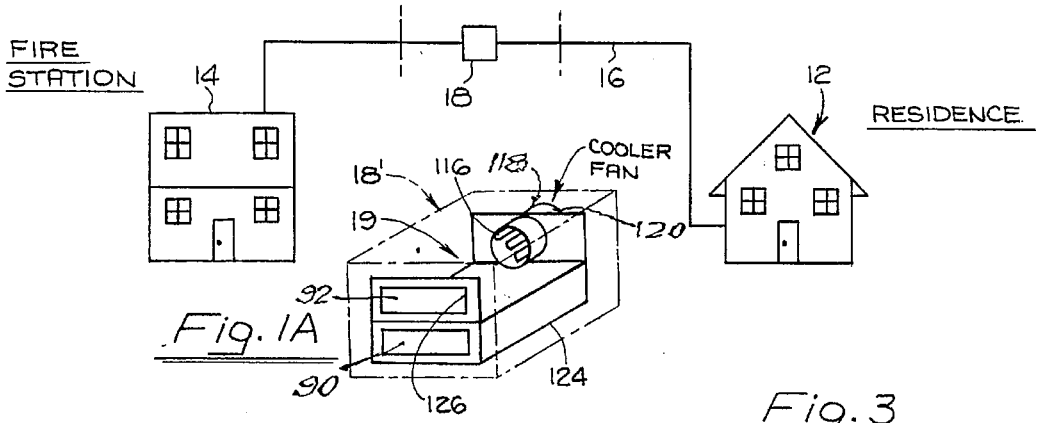
Fig. 1A
Fig. 2
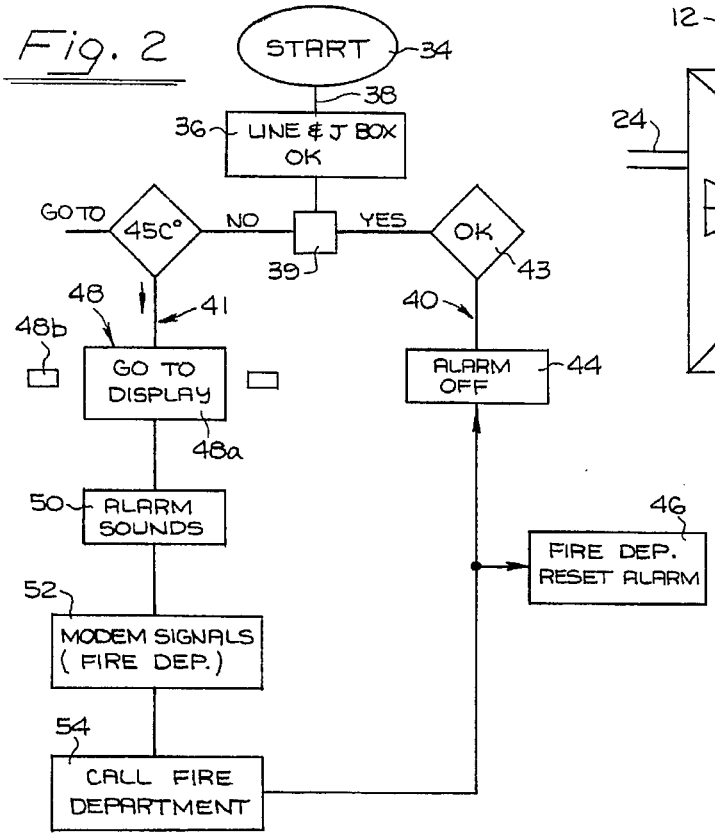
Fig. 3
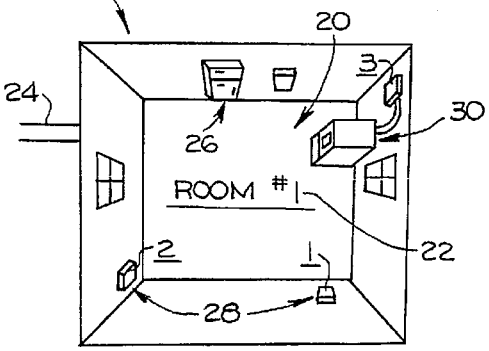
Fig. 4
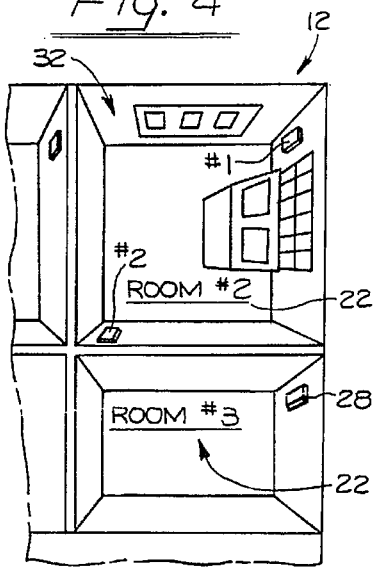

CRT
PHONE LINE
MODEM
P4
RX
TX
CPU
RESET
7
3
4
1
AMP
3-POLE
WR
RD
CE
567
DISPLAY 28a
28
#1
#2
#3
28b
28c
57c
57b
57a
62
63
OP-AMP
CURRENT CONVERTER
60
55
55a
57
CONDUIT
55b
55c
TEMP. MET.
58
59
114
122

120
118

DIG GRD
N/C
N/C
+5V
LOCKOUT EE PROM
PUSH TO CAL
SET POINT 1
ALARM 1
GND EXT
TMS 50C-20
RS 232
P2
SETPOINT 2
ALARM 2
EMERGENCY LIGHTING
ALARM
90dB
COMPARATOR
METER
SAMPLE LINE
P9/P3
RETURN
0-10V
A/D
P5

92
POWER SUPPLY
ALARM
CPU
COOLER FAN
102
28
90
X DRIVER
110
CLR CPU
CLK
98
FIFO MEM.
96
DAVID BOWSER
LCD DISPLAY
78
COMPR.
74
76
A/D
REG. 5V
82
RAM
Y DRIVER
112
PROCESSOR
BUFFER
80
D/A
MUX
94
108
CPU-I/O
UP/DOWN COUNTER
86
72
PRI. ENC. 10 TO 4
MUX
70
BCD DECIMAL
14
AMP
74
TIMER
88
(RTD) INPUTS
32
BUFFER
68
CPU
R/D
66
CP-AMP
VOLT CONV. COLD JUNCTION
63
CONDUIT SAMPLE LINE

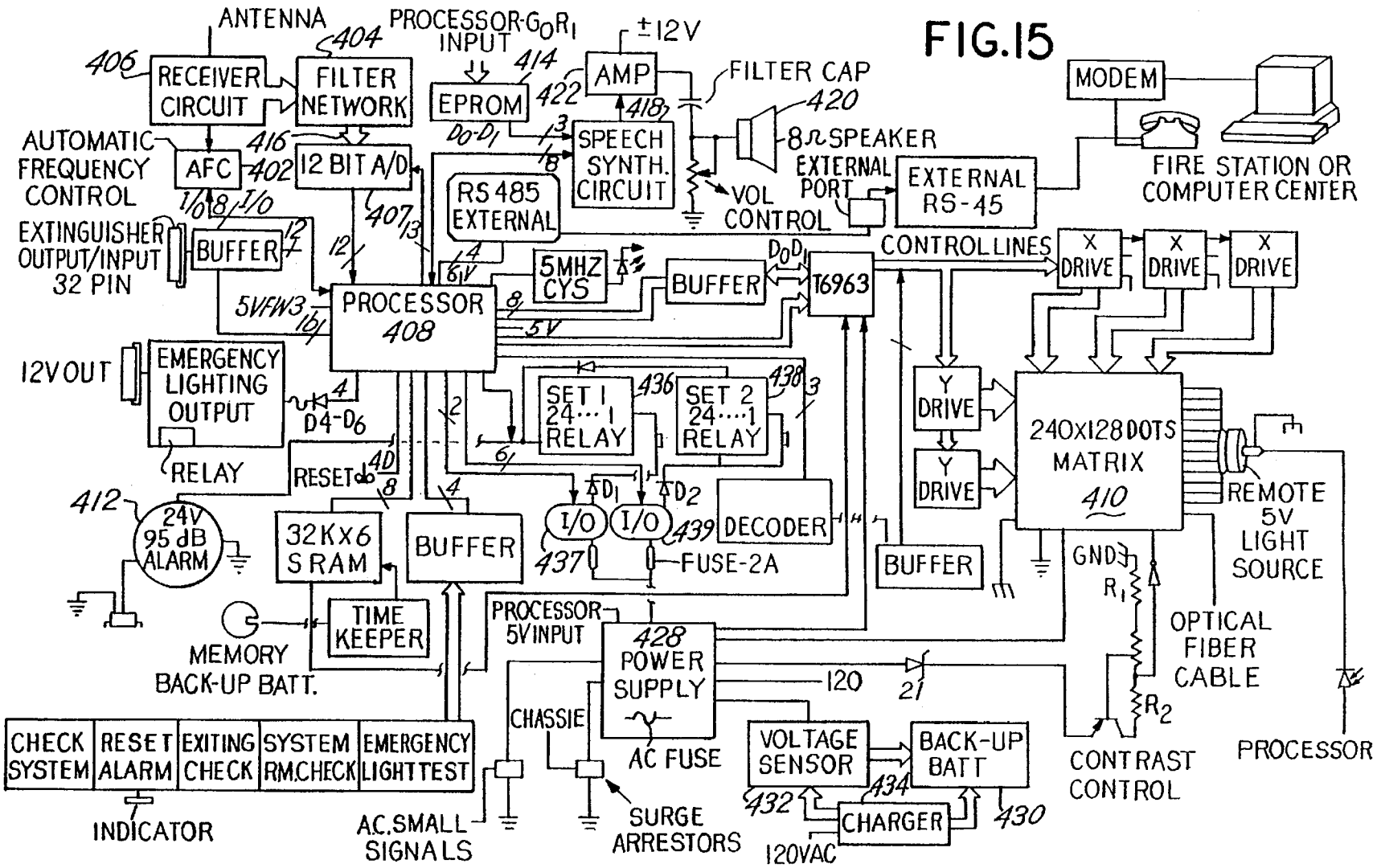
FIG.15
MODEM
FIRE STATION OR COMPUTER CENTER
X DRIVE
X DRIVE
X DRIVE
REMOTE 5V LIGHT SOURCE
PROCESSOR
OPTICAL FIBER CABLE
240X128 DOTS MATRIX 410
GND
R1
R2
CONTRAST CONTROL
EXTERNAL RS-45
CONTROL LINES
Y DRIVE
Y DRIVE
BUFFER
BACK-UP BATT
430
CHARGER
434
VOLTAGE SENSOR
432
120VAC
120
21
8Ω SPEAKER
EXTERNAL PORT
FILTER CAP
420
VOL CONTROL
16963
BUFFER
DECODER
FUSE-2A
SET 2 24...1 RELAY
438
SET 1 24...1 RELAY
436
I/O
439
I/O
437
428 POWER SUPPLY
AC FUSE
SURGE ARRESTORS
CHASSIS
PROCESSOR 5V INPUT
±12V
AMP
418
SPEECH SYNTH. CIRCUIT
422
5MHZ CYS
RS 485 EXTERNAL
PROCESSOR-GO R1 INPUT
414
EPROM
D0-D1
PROCESSOR 408
BUFFER
TIME KEEPER
32KX6 SRAM
RESET
D4-D6
EMERGENCY LIGHTING OUTPUT
RELAY
24V 95 dB ALARM
412
MEMORY BACK-UP BATT.
EMERGENCY LIGHT TEST
SYSTEM RM.CHECK
EXITING CHECK
RESET ALARM
CHECK SYSTEM
INDICATOR
A.C. SMALL SIGNALS
ANTENNA
FILTER NETWORK
404
12 BIT A/D
407
416
402
AFC
406
RECEIVER CIRCUIT
AUTOMATIC FREQUENCY CONTROL
EXTINGUISHER OUTPUT/INPUT 32 PIN
12V OUT

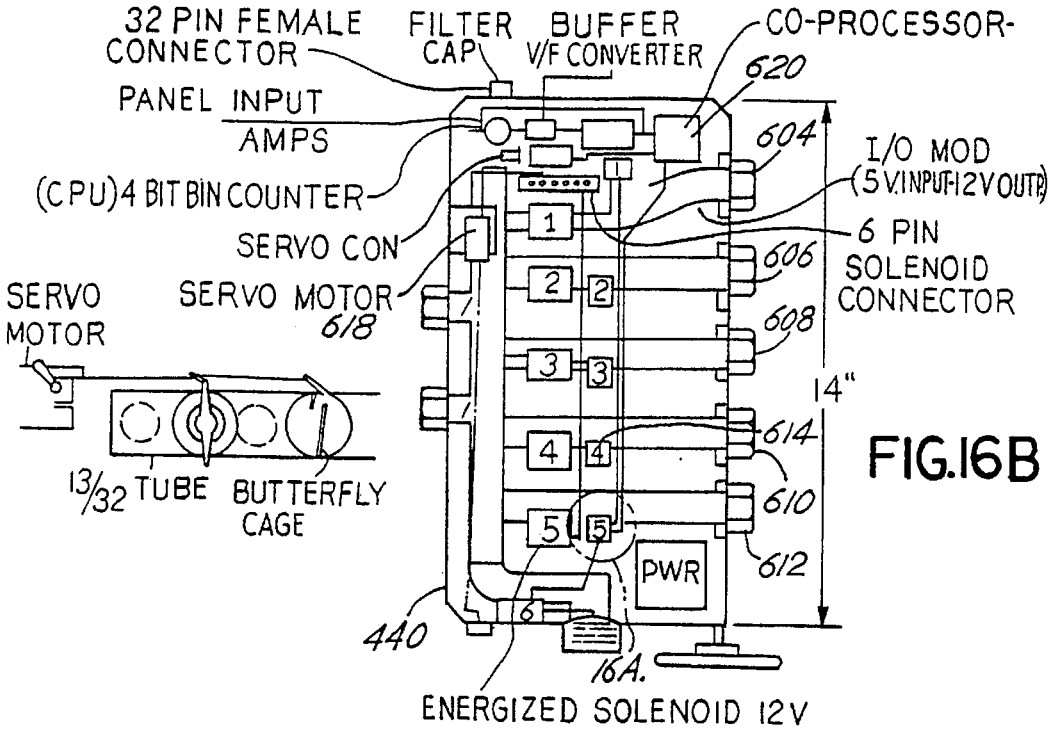
FIG.16B
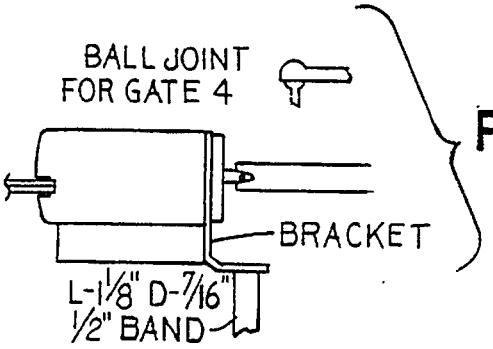
FIG.16 A
FIG. 17
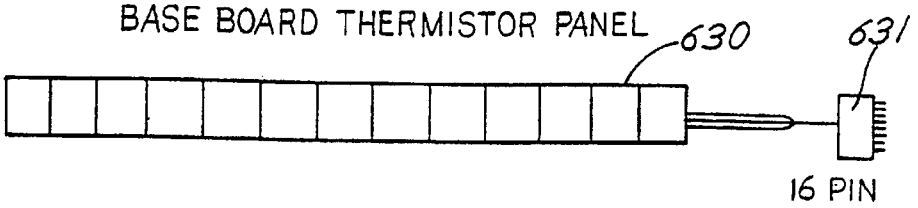

ALARM SYSTEM FOR DETECTING EXCESS TEMPERATURE IN ELECTRICAL WIRING

This is a continuation-in-part of application Ser. No. 7/907,185 filed Jul. 2, 1992, abandoned.

SUMMARY OF THE INVENTION

It is well known that many fires are caused by failures in electrical wiring. Frequently, faulty wiring will generate heat long before the ignition temperature of the surrounding structure is reached. Circuit breakers do not prevent a fire in this situation because the current flowing through the fault is not great enough to trip a standard breaker.

Furthermore, conventional fire detection systems are also inadequate because they only detect the byproducts of combustion, such as smoke and intense heat. The localized heat rise in failing wiring typically goes undetected until after a fire has started.

It would be desirable, therefore, to provide a system capable of detecting heat rises due to faulty wiring before a fire actually breaks out. The system described herein accomplishes this result by detecting such heat increases, pinpointing the locations, providing an alarm, and providing means to extinguish any fire that does occur.

The system provides signals that indicate a potential fire situation. The signals concerned are derived from the standard electrical system in a house or establishment, the signals being developed by shorts or electrical malfunctions, that would produce heat, and possibly a fire.

The system is designed for use in individual locations, such as residences or business establishments.

The main concept of the invention is to detect signals in the individual locations and send them to a central location such as a fire station.

The system provides the identity of the residence, such as the name of the owner, and the address. It also shows the location of the danger point within the residence. These signals are transmitted to the fire station where they are displayed, giving the identifying data referred to above. These signals are also displayed on a display panel within each residence, for the advantage of the occupant.

The system is well adapted for retro-fitting to an existing electrical system in the residence.

Another great advantage is that the apparatus is extremely simple, both in the elements and components making up the system, and the installation thereof. This last advantage includes the fact that the connection between the individual location or residence, and the fire station, consists of only a single telephone line, with only the usual operating appurtenances.

The system is controlled by a microprocessor located in a base unit. An L.C.D. panel located on the base unit enables the user to locate the malfunctioning box. A random access memory stores all data. As an alternative to having each sensor hardwired to the central location, a thermistor or group of thermistors may be connected to a transmitter. The transmitter communicates with the base station using UHF radio signals. The radio datalink allows the unit to perform at long ranges.

Digital and line filters enhance the performance of the radio line. Using a Digital to Analog converter adds speed and accuracy to each bit of data. When the data is displayed on the L.C.D. screen, it shows the malfunctioning box in two dimensions.

An extinguisher unit has the capacity to extinguish any fire that starts within a room in a 360° radius with 12 V solenoids to open and close a hatch door that opens when there's a large source of heat directly under the head or the center of a room. The nozzle is guided toward the heat source through a series of thermistors mounted 4" above the floor on the base board of the room and one or more thermistors on the head of the unit in a circular array.

The 12 V.D.C. motor enables the head via the nozzle to directly turn toward the heat source. Solenoids that are located directly above each 0.25" pipe line open and close a butterfly regulator where the chemical passes through. The chemical used is A, B or C for the purpose of extinguishing wood, textiles and paper rubbish (A), Burning Liquids (B) and Electrical Fires (C), respectively.

The extinguisher tanks are mounted in the basement or equipment room or engineers maintenance room. A distribution box is connected directly to the tanks and copper lines are run from the box to the extinguisher heads. The two tanks are 240 psi @39 lbs. per tank with an 80 ft. range from the tanks to the remote head.

In addition to fire detection and extinguish merit, the system activates emergency lighting and has a voice synthesizer to vocalize all data that's stored in memory, including room, junction or switch box location, e.g., "N.W. wall" or "living room fire on east wall." The location detection is provided by thermistor panels mounted along the baseboards (each sensor is 1"×2" and is glued to a 1¼ W×12" L strip of plastic for mounting on the base board).

The extinguisher system is powered by a 120 VAC source with four outputs ±24 V, ±15 V, ±12 V, 5 V. The unit can operate as an individual unit. The short circuit and excess junction box heat alarms can operate with the base unit. The extinguisher can operate as a stand alone unit with a parallel port that's used for a L.C.D. monitor that shows the room location of the fire in the establishment. When used together the total system is capable of sensing excess heat in the electrical line and extinguishing fires within an establishment.

BRIEF DESCRIPTION OF THE SEVERAL VIEWS OF THE DRAWINGS

FIG. 1 is a semi-diagrammatic view representing the installation of the system of the invention, including a residence and the fire station.

FIG. 1*a* is a diagrammatic perspective view of a unit that includes the components of the present device, as a package.

FIG. 2 is a diagram of the main components of the system, indicating the main steps in the operation thereof.

FIG. 3 is a semi-diagrammatic plan view of one room of the residence.

FIG. 4 is a semi-diagrammatic plan view of several rooms of a residence, different from that of FIG. 3.

FIG. 15 shows a block diagram of an embodiment of the base station circuitry.

FIG. 16A shows a blowup view of a solenoid controlled valve.

FIG. 16B is a detail view of the electromechanical tank control.

FIG. 17 shows a baseboard thermistor panel.

DETAILED DESCRIPTION

Figures 5, 6, 8, 9:
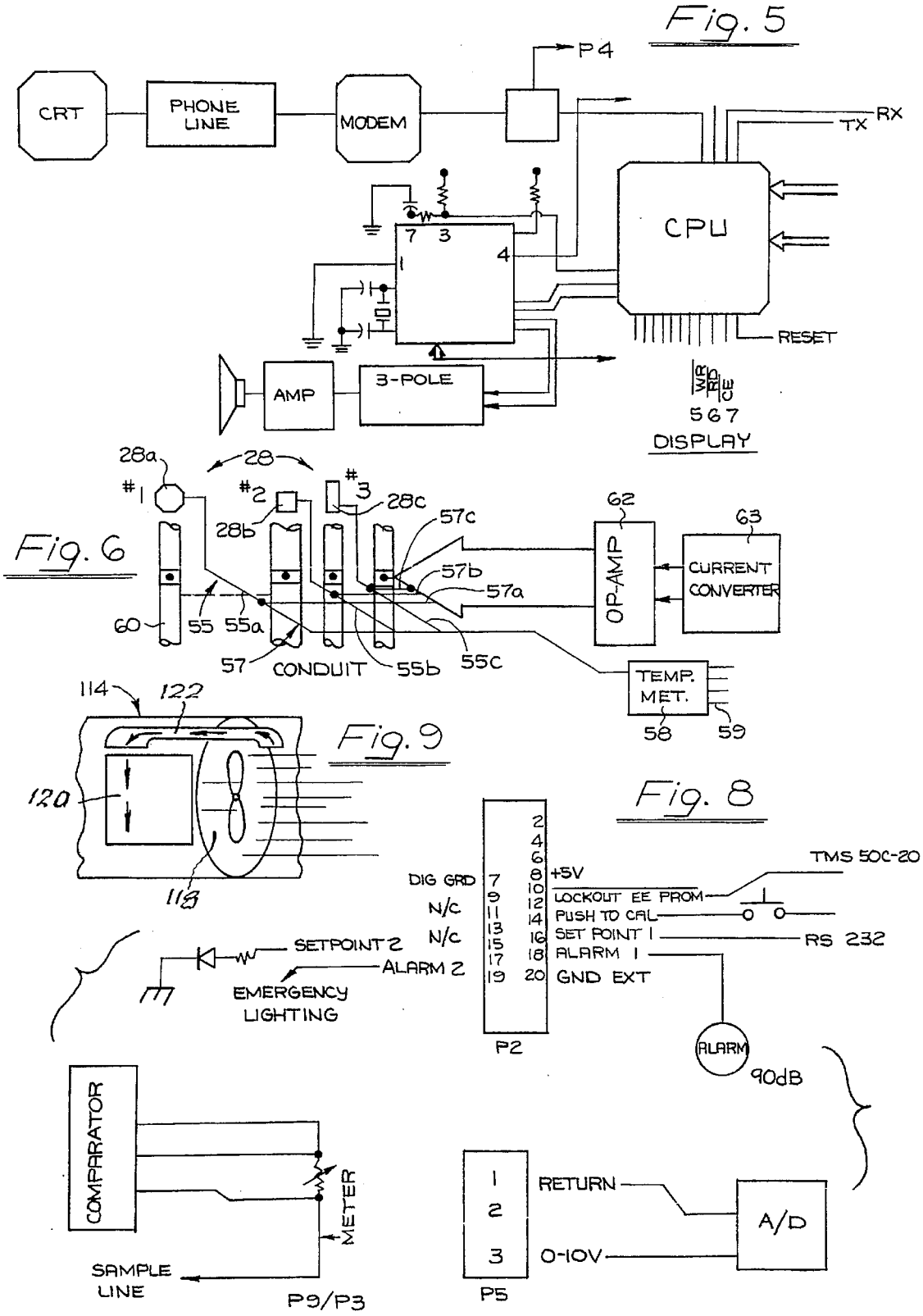
FIG. 5 is a diagram of a portion of the electronic components in the system.
FIG. 6 is a diagram of other components in the system.
FIG. 8 is a diagram of still other components in the system.
FIG. 9 is a detail view of a component contained in FIG. 1*a*.

Attention is directed first to FIG. 1 representing the overall arrangement of use of the fire alarm system, where a residence is indicated at 12 and the central station at 14 which may be a fire station, as in the present instance. These locations, i.e. residence and fire station, are interconnected by a single telephone line 16 constituting the only necessary connection therebetween. Various components are indicated at 18, utilized in the telephone line, including any that are necessarily in the telephone central station. The single telephone line 16 is utilized in a manner presently known, such as in use with the well known FAX machines.

FIGS. 1, 3 and 4 indicate or show various portions of the electrical system in the house, and telephone components, and it will be appreciated that they are very extensive physically and spatially, and it is desired to point out that the components of the device of the present invention are contained effective entirely in the package represented in FIG. 1*a*. As indicated above, in the electrical system in a residence, sometimes a short, or other malfunction, occurs and heat immediately develops from such short. This heat is utilized by the system in producing warning signals of a potential fire.

Such shorts often occur, and probably most often, in junction boxes or other similar components in the electrical system. The junction boxes include casings enclosing the various elements, including sockets, and shorts often occur in such sockets, producing the heat which is of course transmitted to the casing. The heat produces voltage and corresponding current, although slight, and signals therefrom are transmitted to a desired display panel, principally in the fire station, but also within the residence itself for the immediate attention of the occupants.

FIG. 3 represents one room 20 of the residence 12, which may for example be the basement in the house. For convenience this room or space is identified room #1 as indicated at 22, and other rooms in the house are similarly identified by number as will be referred to again hereinbelow.

The electrical system in the residence or house is indicated by a main electrical line 24 and the circuitry is distributed throughout the house in the usual way. An electric meter is indicated at 26, and a plurality of junction boxes 28 are shown. These junction boxes contain sockets, one in this case being utilized for connecting an appliance 30.

The junction boxes 28 may be any of various kinds as referred to above. They are known to be of the shapes shown in FIG. 6, where they appear as square, octagonal and rectangular not square. These shapes appear as pictures on the display, in the case of a warning signal, as referred to again hereinbelow.

FIG. 4 shows the interior of the residence 12 at another level, such as the first floor, above the basement 20 of FIG. 2. The particular identity of each room is not essential, the overall purpose being to show a plurality of rooms. In FIG. 3 the various rooms are again individually identified as to room number as indicated at 22, and in this case also they are provided with various junction boxes 28 individually identified by number, and thus in the aggregate being individually identified as to room number and junction box number.

In FIG. 4 room #2 may for example be the kitchen, and the kitchen is a convenient location to have a display panel mounted, as indicated at 32, but it can be located in any desired place. This display panel will be referred to again hereinbelow, in the description of the operation of the computer circuitry.

Reference is made to FIG. 2 showing in very general form the main components of the electrical circuitry used in the alarm system. A starting point is indicated at 34, and an indicator 36 is provided to show that the junction boxes are in safe condition. A conductor 38 leads from the indicator 36 to a switch 39 which is normally closed to the right hand portion of the circuit indicated at 40, but normally open to the left hand portion of the circuit at 41. In its normally closed position, connected in circuit with the components 34, 36, are a signal device 43, and alarm OFF signal device 44, and a reset alarm 46.

In the left hand portion of the circuit as shown, are a temperature indicator 47, and a display means 48, this display means including two separate display panels 48*a*, 48*b*. Also included in this portion of the circuit is an audio alarm means 50, a modem 52, and a visual signal means or panel 54, the latter being connected with the component 46, in the right hand portion of the circuit.

Referring to the specific steps in the operation of the alarm system, reference is made to FIG. 6, which includes three junction boxes 28, individually identified 28*a*, 28*b*, 28*c*. Connected with the junction boxes 28 are conductors 55, individually identified 55*a*, 55*b*, 55*c* leading to a common conductor 56 which in turn leads to a temperature meter 58 of known kind. This temperature meter is operable for sensing the signals from the heated casings of the junction boxes. Associated with the junction boxes are cables 60 to indicate the complete connection in circuit of the junction boxes, but which do not enter into the signals utilized in the present case that are transmitted through the conductors 55. Other conductors 57, individually identified 57*a*, 57*b*, 57*c* leading from the junction boxes to the OP-AMP 62 for producing comparison signals referred to hereinbelow.

Upon a danger condition occurring, i.e. a short and consequent heating of the casing of a junction box, a signal is transmitted through the corresponding conductor 55 (FIG. 6), and is transmitted to the OP-AMP 62, which amplifies the signal. The signal is then transmitted to a current converter 63, and from there to a voltage converter 64 (FIG. 7) the current converter 63 being provided to eliminate distortion of the signals that would occur if they were left as voltage signals.

The current signal converted by the voltage converter 64 is then transmitted to the A/D 66, and then to the buffer 68, which produces a clean signal, that is, it removes all of the distortion, and it speeds up the signal. The signal issuing from the buffer 68 is then split and proceeds simultaneously to the MUX 70 and a priority encoder 72.

The priority encoder 72 picks up whichever one of the lines 74 leading from the buffer that has a signal applied thereto. A great number of these lines are present, and processed. The MUX 70 actually performs the switching step, to connect the line that was selected by the priority encoder 72.

Reference is next made to a component or unit 74 (FIG. 7) which includes a step-down transformer 76 and a comparator 78, the function of these latter two elements being referred to again hereinbelow. Referring again to the function of the MUX 70, the signal upon leaving the MUX is transmitted through the D/A 80 which transmits the signal to the transformer 76, in the unit 74.

The signal was amplified in its transmission to this point, through the OP-AMP 62, and it is to be reduced, or decreased, the transformer 76 having such step-down characteristics for that purpose. This reduced signal is then transmitted to the comparator 78, and that signal is compared with the signal coming through the conductor 79, via thermistor 81, which is the original signal coming from the conductors 57 (FIG. 6).

Reference is made to a voltage regulator 82 which provides a suitable voltage such as 5 V for the processor unit. This unit including the buffer 68, priority encoder 72, MUX 70, decimal BCD 84, UP/DOWN counter 86, timer 88 and LCD display panel 90.

The comparator 78 compares the original signal in the line 79 with the step down signal from the transformer 76 and transmits it to the temperature display panel 92, and as indicated at that point, this signal produces the actual temperature reading and when that temperature surpasses the selected point, which in this case is 85° C., then the apparatus is put into operation. When the signal is 85° C. or less the apparatus is dormant.

Referring again to the diagram of FIG. 2, it is pointed out that when the temperature exceeds 85° C. the switch 39, which is heat responsive, closes and connects into the apparatus those elements on the left hand side of FIG. 2, and the signal is transmitted to the display panel at the fire station. As noted above, this display indicates the location of the building or residence, by name and address, and the fireman come to the location and take whatever steps necessary. It is contemplated that there will be an arrangement between the fire department and the electrical union, and a union member will appear on the scene together with the fireman, to make any corrections necessary in the system, there at that time.

Referring again to FIG. 7, it is pointed out that the signal coming from the MUX 70 goes to the point 94, and is there split, one signal going to the unit 123 and the other signal to the FIFO memory 96.

Included in the circuit is a digital clock 98 which processes the FIFO memory 96. This signal is processed and then transmitted to the RAM 100, and the signal from this component proceeds to the processor 102, which processes signals for the circuit and particularly to the LCD display panel 90. This panel shows a picture of the junction box where the danger signal is produced, this representation of the box having been entered into the signal processor previously in the manual set up of the entire system. The display that appears on the display panel 90 is identical with that in the fire station foe simplicity purposes, and includes the name and address of the residence owner, notwithstanding the fact that the display panel 90 is located in that residence. Also included in the information or data in the display is the location of the source of the danger signal including room number and junction box number, e.g., Rm 6, No. 4, etc. The picture of the junction box will facilitate and speed up the action required for correcting the fault, in facilitating recognition of the particular junction box.

Figure 7:
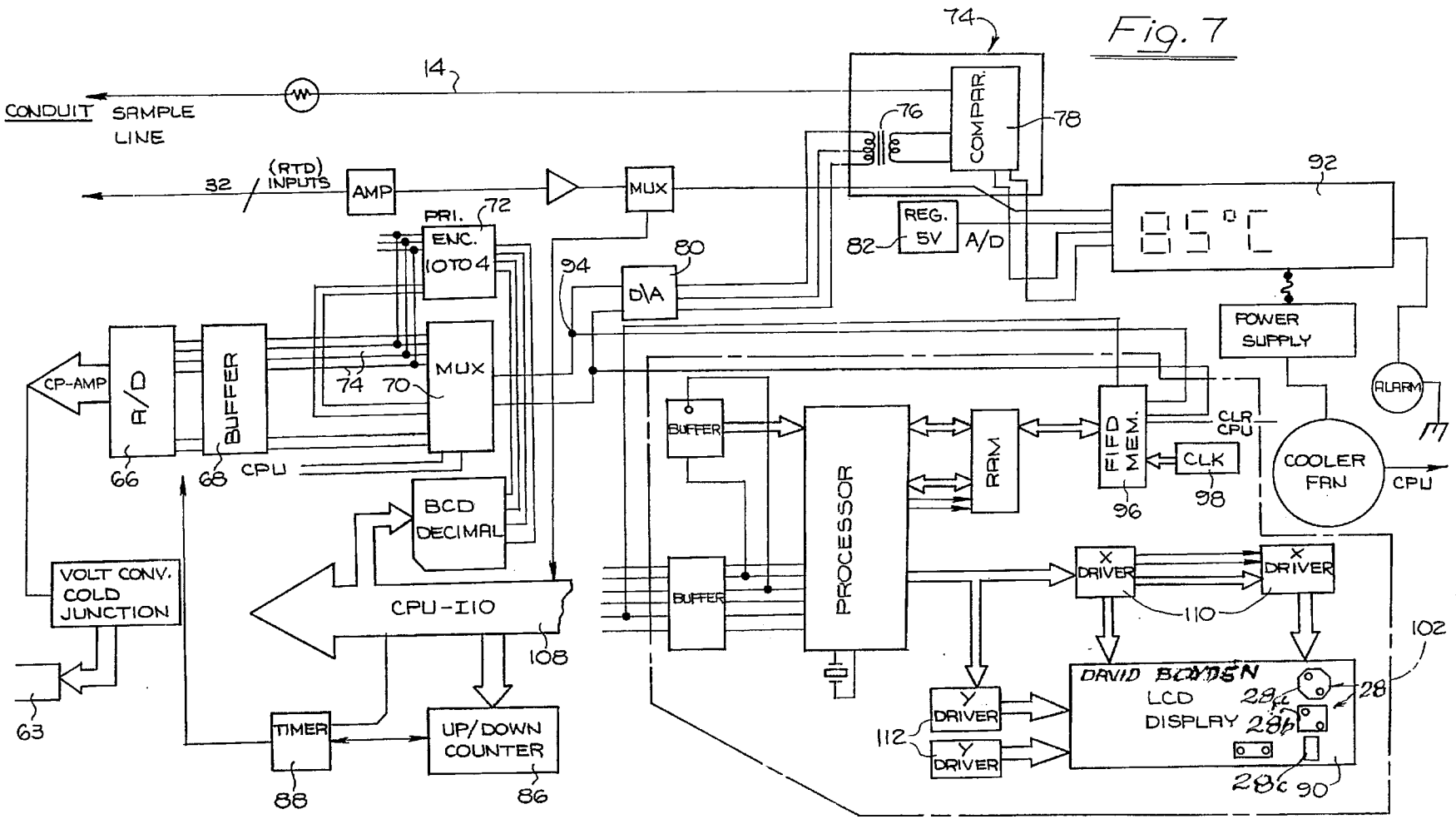
FIG. 7 is a diagram of other components directly associated with FIG. 6.

Reference is made again to the lower right hand portion of FIG. 7 where a dot/dash enclosing line 102 surrounds a number of components together forming a prepared package, that may be bought off the shelf. Broadly and briefly, it includes two buffers 104, 106 which smooth out the signal coming from the CPU 108, and transmit it to the signal processing unit which the LCD display 90 and the drivers thereof, these drivers including two x-drivers 110 and two y-drivers 112.

The alarm apparatus includes a back up safety component 114, incorporated in the unit 19 of FIG. 1A, which includes elements 116 cooled by a fan 118 driven by a motor 120 connected in the residence electrical circuit, and air control means 122 for directing the air over the motor (FIG. 9). The unit 19 includes substantially the entire circuitry of the alarm system, and to point up its effectiveness, the unit may be on the order of 8–10" in its major direction. The casing 18' is simply for containing the unit in marketing handling. As shown in FIG. 1A, the unit includes a box-like main member 124 on which a panel 126 is mounted containing the display panel 92. The main member 124 includes the panel 90.

The device of the invention can be readily acquired by buying it in package form, as shown in FIG. 1*a*, which is small, compact, and easily handled and put in plan.

Figure 10:
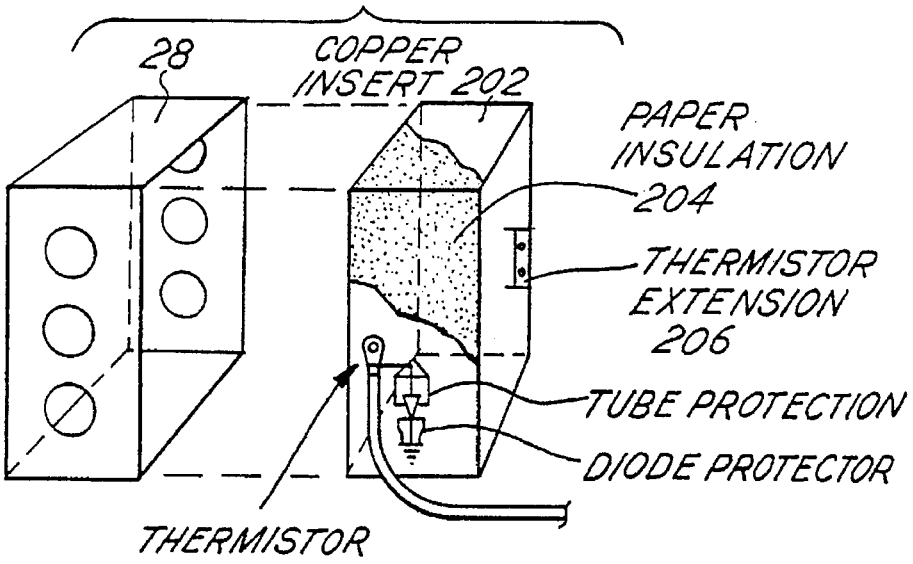
FIG. 10 shows a perspective view of a junction box connected to a thermistor.

Referring to FIG. 10, a perspective view of a junction box 28 is shown. The junction box 28 may advantageously include a copper insert 202 and insulating means such as paper 204 to isolate the insert electrically. The junction box 28 has affixed to it a thermistor 81 which has as its output a voltage proportional to its resistance, which varies with temperature as is well understood by those skilled in the art. The thermistor 81 may be attached to the junction box 28 in any convenient manner, so as to afford good thermal and ambient temperature measurement of box 28. Alternatively, the thermistor 81 may be attached to the insert 202 to achieve even better thermal conductivity.

The thermistor 81 is connected to the circuitry of FIG. 7 through conductor 79, which may be located conveniently located on either the inside or outside of the AC power conduit.

Figure 11:
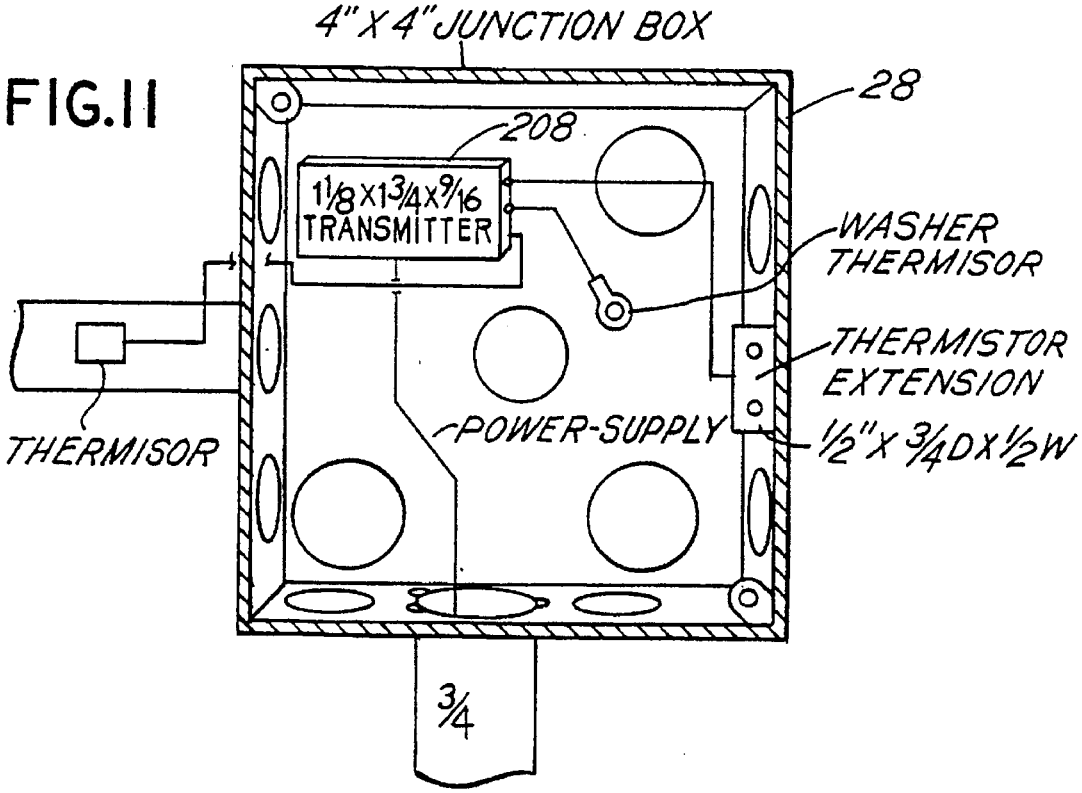
FIG. 11 shows a plan view of a junction box protected by multiple thermistors.

FIG. 11 shows an alternative arrangement where starting at the junction box 28, a thermistor is also used to detect excess heat signals produced by shorts or overloads within the electrical system. Whenever a signal is produced its output is inputted to a transmitter 208 mounted in each location where there's a thermistor. The transmitter 208 sends the temperature and a timing signal to the main receiver board located in the base unit. (FIG. 15). The transmitter 208 is shown inside a junction box 28 but for convenience and to save space may be located on the outside of a junction box 28 as well. In the event of a fire, a plurality of thermistors located along the baseboards of a room 22 indicate the presence of a fire in the room. The baseboard thermistors and other thermistors located in junction boxes or at other locations where detection is required are wired to transmitter 208 located wherever a thermistor is mounted. Wherever a signal from the thermistor has an output, the transmitter 208 sends a signal to the main board or base unit (shown in FIG. 15) where the signal is filtered and digitized.

FIG. 15 shows the base unit block diagram. This is an advanced version of the unit of FIG. 7 with radio control. Signals are received from extinguisher units 344 or other remote devices connected via radio by receiver 406. An automatic frequency control circuit 402 compensates for variations in frequency. The digitized signal is then inputted to a 12 bit successive approximation A/D converter 407 before reaching the microprocessor 408. The coded signal is in ACSII format. The information that's stored is displayed on a graphic display 410 where the room, outlet and box type are displayed.

The processor 408 also outputs a signal to a 24 V (28 mA) alarm 412 and the EEPROM 414 sends data to a voice synthesizer 418. The voice synthesizer output 419 goes to Op-Amp 422 which drives an eight Ohm speaker. The voice synthesizer 418 is connected with a serial interface to the EEPROM's I/O port 415. The serial mode allows the synthesizer circuit 418 to enter the sentence number to be synthesized with one receive line. The receive line characteristics are 1200 bits/second, 8 bit data, even parity.

The system can be reset by a reset code. Knowledge of the reset code can be restricted to service and management personnel.

The main board also includes a power supply 428 with battery backup 430. A voltage sensor 432 and charger 434 keep the battery 430 charged.

In operation, the processor 408 triggers a first alarm by triggering a first relay 436 through I/O Module 437. The processor is programmed to trigger this first alarm when the temperature received by the processor 408 from the thermistor 81 exceeds a predetermined threshold warning level. When a received temperature exceeds a second predetermined level indicative of an actual fire, the processor 408 triggers a second relay 438 through a second I/O Module 439. The thresholds can be varied by appropriate changes in software of the processor 408.

Figure 12:
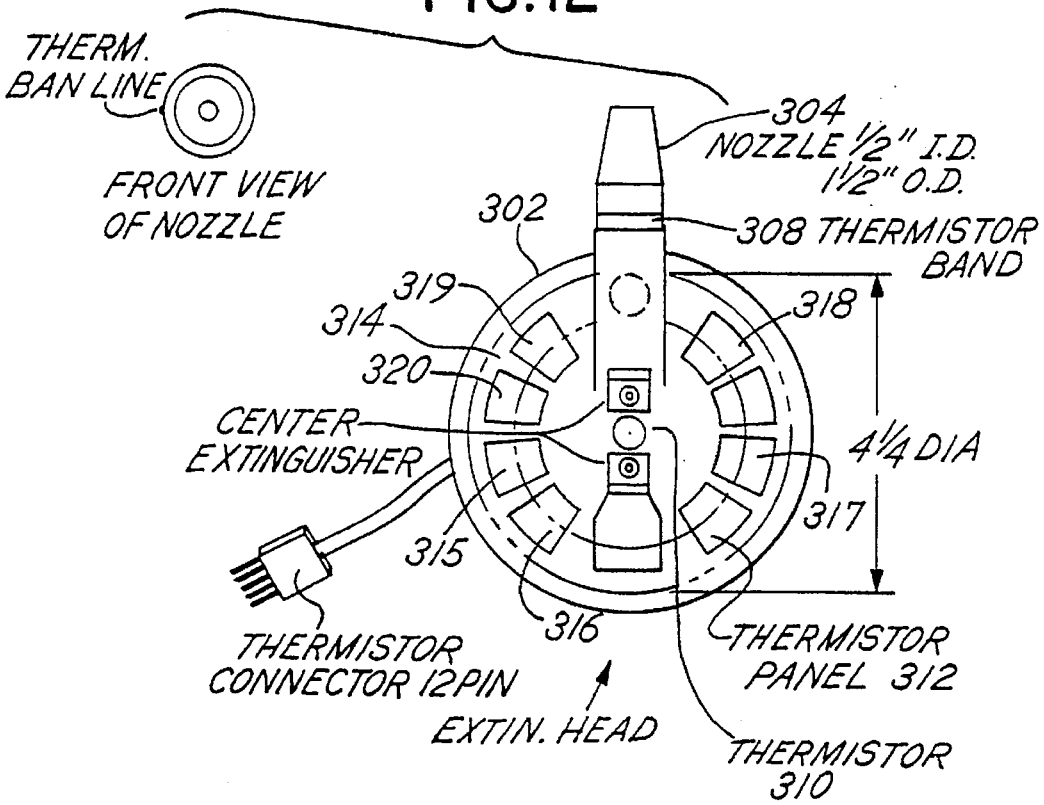
FIG. 12 shows a top view of the extinguisher unit.

FIG. 12 shows the extinguisher 302. The extinguisher includes a nozzle 304 rotatably mounted on a chassis 306. (Shown in FIG. 12). The extinguisher may include thermistors 308, 310, and 312 located on a rotating housing 314. The nozzle 304 and housing 314 may be advantageously molded as a single unit and are designed to rotate 360°.

The extinguisher can suppress a fire within an establishment. The rising heat is detected by thermistors 315–320 in a circular array on the extinguisher head, with one sensor 310 centered for aiding in sensing heat directly under the head 314.

Figure 13:
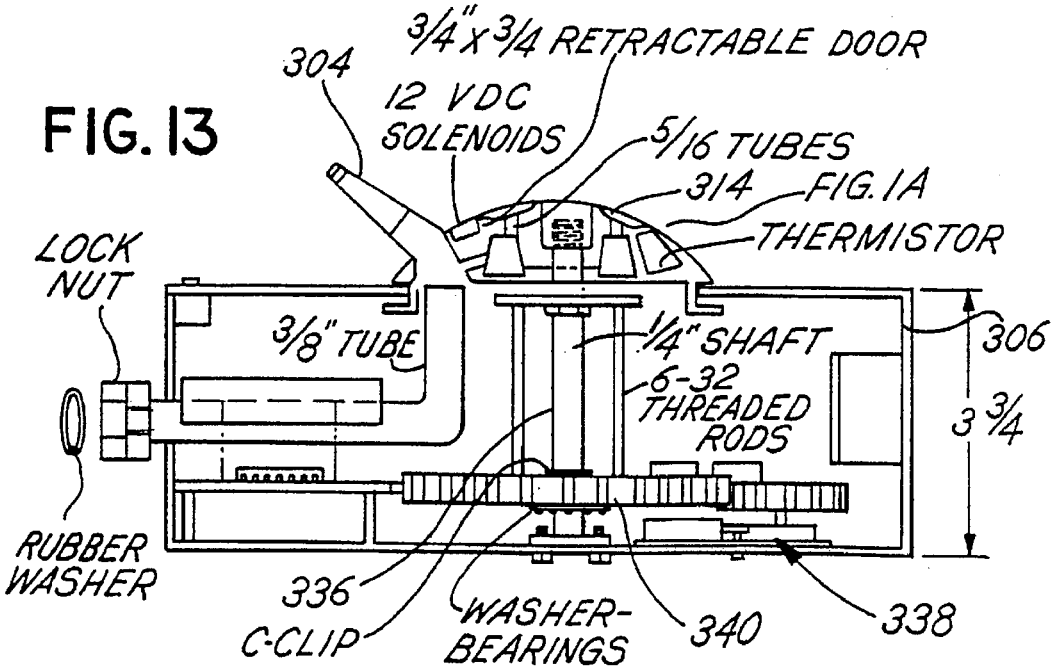
FIG. 13 is a cross-sectional view of the extinguisher unit.

FIG. 13 shows a cross section through FIG. 12. Apparent are rotating shaft 336, drive mechanism 338, and gears 340 for rotating the extinguisher head 314.

Figure 14:
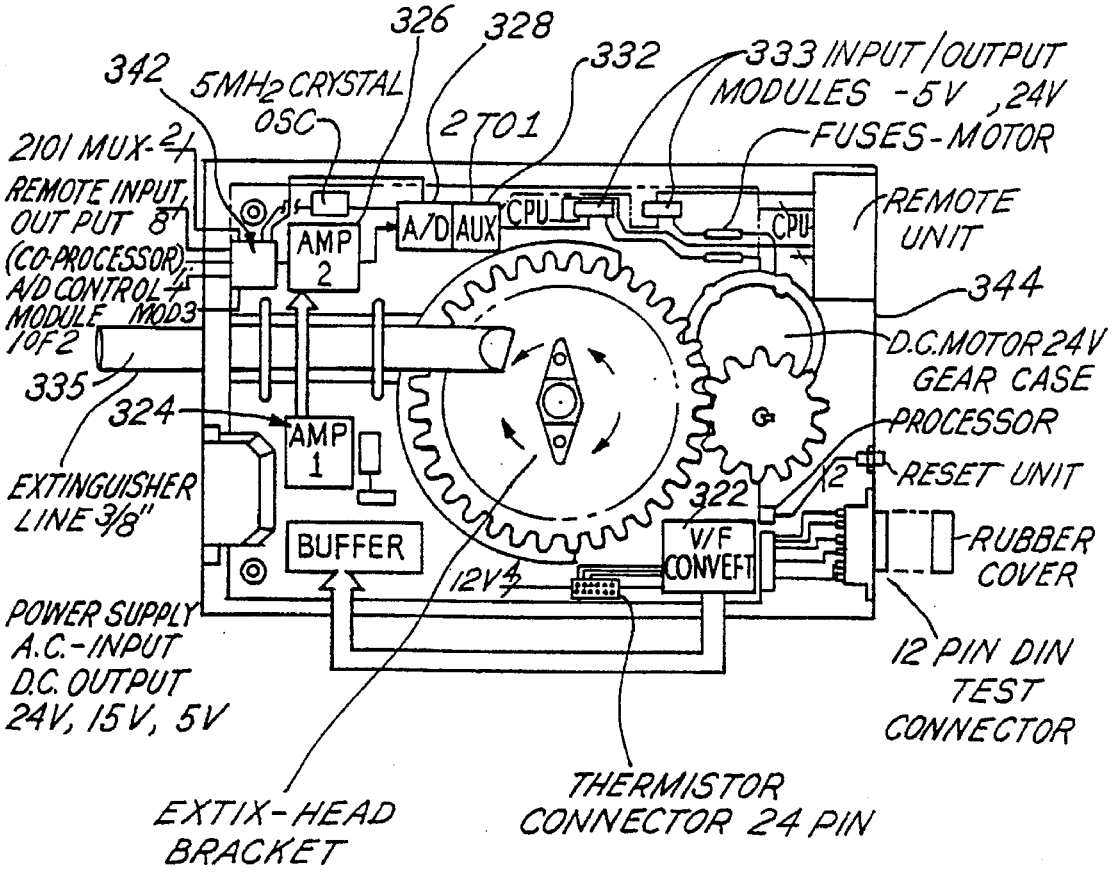
FIG. 14 is a block diagram which shows the control logic for the extinguisher in the base of the unit.

FIG. 14 shows a block diagram of the circuitry associated with the extinguisher. Signals from the thermistors are transmitted to the base unit and to the extinguisher control circuit. The extinguisher circuitry is operable to rotate the extinguisher nozzle 304 toward a heat source detected by a baseboard thermistor panel 630 and dispense an extinguishing material. The extinguisher also communicates with the extinguisher supply tank controls 440 to turn on the supply of extinguisher fluid to the active head.

Figure 16:
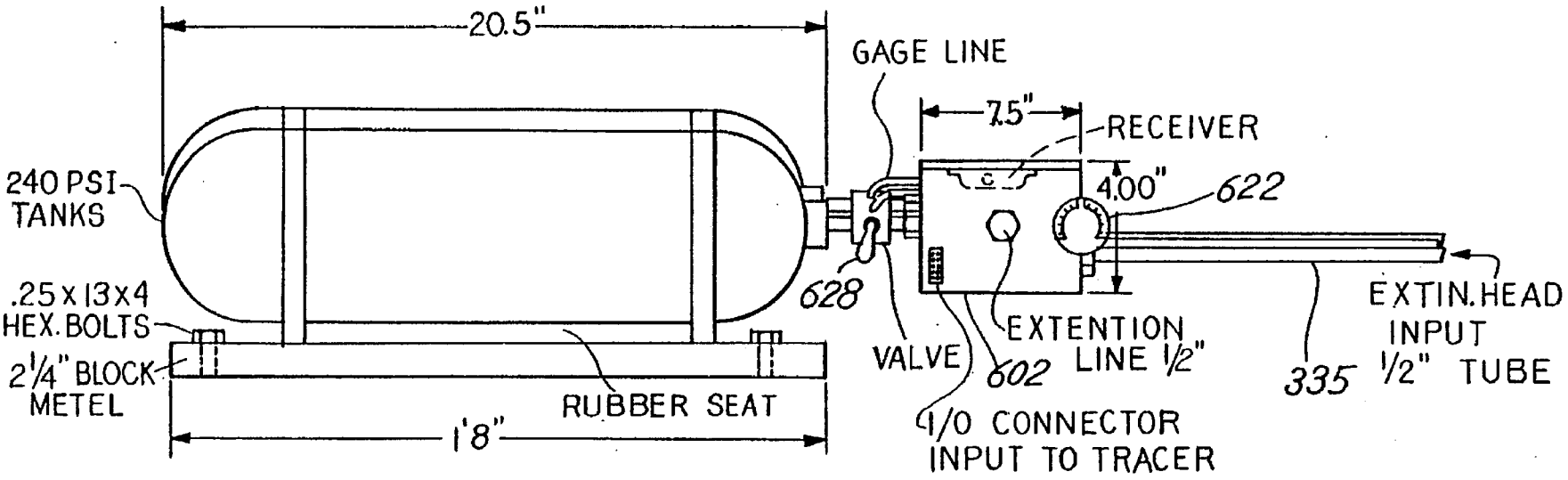
FIG. 16 shows the electromechanical controls for the tanks which supply the extinguisher.

FIG. 16 shows the distribution tanks and circuity for the extinguisher supply tanks. The tanks 601 contain the extinguishing material of the desired type. A control box 602 contains the mechanical controls for the extinguishing material and the electronic controls as well. The input tube 335 from each extinguisher is selectably connectable to any one of the tanks 601.

Each line 604, 606, 608, 610, and 612 has a 12 V solenoid 614 directly over each line with a ⅛" diameter push rod with ball joint ends; the ball is connected to a 14/32" butterfly valve with a ball at the end. Whenever the chemical is released, the servo motor 618 is signaled by the extinguisher, in synchronization with the solenoid 614 that's been signalled by the co-processor 620 which is in communication with individual extinguisher units.

The tank gauge 622 is 1.25" in diameter, and the line from the gauge is connected to the two tanks 601 for monitoring. The extension connector 624 is for adding other units. Each tank weights 39 lbs., is 20.5" in length and 7" in diameter. The 32 pin connector 626 is the input for the thermistor panel that's located on the opposite side of the gauge. Each tank has a shut off valve 628 for installation and use. Only one tank is used at a time. After the first tank is emptied, the second one is turned on manually. The I/O port located on the side of the control box 602 is connected to the base unit's I/O port. All output data from the extinguisher is displayed on the same L.C.D. screen 410.

FIG. 17 shows a baseboard thermistor panel 630 with a connector 631 which is operable to connect the panel to a transmitter 208.

From the foregoing, it can be seen that a flexible system has been developed that is capable of detecting a dangerous heat rise, directing a user to the location of that heat rise, and extinguishing the source of the fire.

What is claimed is:

1. An alarm system for use in a residence or business establishment, comprising:

an electrical junction box containing electrical wiring;

a thermistor for detecting a change in temperature of said junction box and for generating an electrical signal in response thereto;

a thermistor for detecting a change in temperature of said junction box and for generating an electrical signal in response thereto;

said thermistor also having a protection device;

alarm conductor means for conducting said electrical signal, said alarm conductor means being connected to said temperature sensing means;

comparison means connected to said alarm conductor means for comparing said electrical signal to a threshold signal level; and display means connected to said comparison means for displaying an indication of temperature when said electrical signal exceeds said threshold signal level;

wherein said thermistor is attached to said electrical junction box in a thermally conducting relationship; and wherein a transmitter transmits data received from said thermistor to a base station via UHF radio transmission.

2. An alarm system for use in a residence or business establishment, comprising:

an electrical junction box containing electrical wiring;

a thermistor for detecting a change in temperature of said junction box and for generating an electrical signal in response thereto;

alarm conductor means for conducting said electrical signal, said alarm conductor means being connected to said temperature sensing means;

comparison means connected to said alarm conductor means for comparing said electrical signal to a threshold signal level; and display means connected to said comparison means for displaying an indication of temperature when said electrical signal exceeds said threshold signal level;

wherein said thermistor is attached to said electrical junction box in a thermally conducting relationship and said thermistor includes means to transmit data to extinguisher units located in an establishment.

3. An alarm and extinguisher system for use in a residence or business establishment, comprising;

a base unit, operable to receive signals from temperature sensing means and transmit signals to extinguisher means;

an extinguisher, connected to said base unit via a UHF radio line;

a tank containing extinguishing material, said tanks being connected by an I/O port to said base unit;

a plurality of heat sensors located on the baseboards of an establishment, wherein said heat sensors are operable to signal a rise in heat; and said extinguisher means being adapted to swivel towards the heat sensor of said plurality of heat sensors which indicates that there is a rise in heat.

4. The system of claim 3 in which said heat sensors are thermistors.

5. A method of detecting and extinguishing fires, comprising the steps of detecting a rise in heat at a junction box with a thermistor in thermal contact with said junction box;

sending a signal to a base unit microprocessor from said thermistor, displaying a visual indication of the location of said junction box, transmitting location information to a rotating extinguisher head, pointing said extinguisher head at the location, and extinguishing the fire.

* * * * *